US006964596B1

(12) United States Patent
Abramyan

(10) Patent No.: US 6,964,596 B1
(45) Date of Patent: Nov. 15, 2005

(54) PUSH-UP BRA HAVING ATTACHABLE NIPPLES

(76) Inventor: Elena Abramyan, 58 Railroad Ave., Staten Island, NY (US) 10305

( * ) Notice: Subject to any disclaimer, the term of this patent is extended or adjusted under 35 U.S.C. 154(b) by 13 days.

(21) Appl. No.: 10/798,139

(22) Filed: Mar. 11, 2004

(51) Int. Cl.[7] ..... A41D 3/00
(52) U.S. Cl. ..... 450/81; 450/39
(58) Field of Search ..... 450/1, 54–58, 450/80, 81, 79, 39, 82, 88; 623/7, 8; 128/890; 2/267, 268, 455, 463

(56) References Cited

U.S. PATENT DOCUMENTS

| | | | | |
|---|---|---|---|---|
| 2,079,426 | A * | 5/1937 | Schottenfels | 450/81 |
| 2,869,553 | A * | 1/1959 | Nicl | 450/81 |
| 4,127,128 | A * | 11/1978 | Schmidt | 450/1 |
| 4,195,639 | A * | 4/1980 | Lee | 450/57 |
| 4,199,825 | A | 4/1980 | Knoche | |
| 4,227,536 | A * | 10/1980 | Shimenkov et al. | 450/55 |
| 4,241,737 | A * | 12/1980 | Schmidt | 450/1 |
| 4,640,288 | A * | 2/1987 | Hattori | 450/81 |
| 4,992,074 | A * | 2/1991 | Diaz | 450/81 |
| 5,458,635 | A | 10/1995 | Berman | |
| 5,755,611 | A * | 5/1998 | Noble et al. | 450/39 |
| 5,824,075 | A | 10/1998 | Thielbar | |
| D419,279 | S | 1/2000 | Marco et al. | |
| 6,110,006 | A | 8/2000 | Chen | |
| 6,183,340 | B1 | 2/2001 | Wen | |
| 6,213,841 | B1 | 4/2001 | Kuo | |
| 6,231,424 | B1 * | 5/2001 | Valentin | 450/81 |
| 6,257,952 | B1 * | 7/2001 | Valentin | 450/81 |
| 6,338,665 | B1 | 1/2002 | Dawson et al. | |
| 6,383,055 | B2 * | 5/2002 | Valentin | 450/81 |
| 6,443,806 | B1 | 9/2002 | Fang | |
| 6,645,042 | B2 * | 11/2003 | Davis | 450/88 |
| 6,758,720 | B2 * | 7/2004 | Chen | 450/57 |
| 6,780,081 | B2 * | 8/2004 | Chen et al. | 450/81 |

* cited by examiner

*Primary Examiner*—Gloria M. Hale
(74) *Attorney, Agent, or Firm*—Goldstein Law Offices, P.C.

(57) ABSTRACT

A push-up bra for wear by a user, having a pair of breasts. The push-up bra includes a pair of cups each having a periphery. A flange extends outwardly from a portion of the periphery of each cup. The flange has a first surface, a side tab, and an upper tab. The first surface of the flange has an adhesive lining for easily attaching around the breasts of the user. A clasp is attached to a portion of the flange between each breast and holds the cups securely in position against the breasts. The side tabs and upper tabs are pulled taughtly to lift the breasts and enhance cleavage.

13 Claims, 3 Drawing Sheets

PUSH-UP BRA HAVING ATTACHABLE NIPPLES

BACKGROUND OF THE INVENTION

The invention relates to a push-up bra, and more particularly, to a backless and strapless push-up bra having two molded cups for lifting and enhancing the natural appearance of breasts.

Most women are conscious of their bodies and the way they look, and in particular, their breast size. Some women have taken their breast self-consciousness to the next level by electing to have silicon breasts surgically implanted into their bodies. However, many more women prefer to enhance their breast size by wearing push-up bras. Push-up bras are obviously less expensive than silicon implants and they offer women the same self-assurance. Push-up bras also provide women who have had mastectomies and those with under-developed breasts an affordable opportunity to flaunt cleavage.

U.S. Pat. No. 4,199,825 to Knoche discloses a breast prosthesis that is inserted or placed in a brassiere. U.S. Pat. No. 5,458,635 to Berman discloses an artificial breast form, which includes contoured molded breast shaped layers that are sculptured to create a cosmetically accepted appearance. U.S. Pat. No. 5,824,075 to Thielbar discloses a custom formed breast appliance. U.S. Pat. No. 6,110,006 to Chen discloses a functional bra having a silicon gum cup padding. U.S. Pat. No. 6,183,340 to Wen, and U.S. Pat. No. 6,213,841 to Kuo, both disclose structures for a brassiere cup. U.S. Pat. No. 6,338,665 to Dawson discloses a protective breast covering assembly for protecting a breast from the surrounding environment after a surgical procedure. U.S. Pat. No. 6,443,806 to Fang discloses a breast lift for a brassiere. U.S. Pat. No. D419,279 to Marco discloses and ornamental design for a strapless, backless brassiere.

While these units may be suitable for the particular purpose employed, or for general use, they would not be as suitable for the purposes of the present invention as disclosed hereafter.

SUMMARY OF THE INVENTION

It is an object of the invention to produce a push-up bra that gives freedom and comfort to a pair of breasts therein. Accordingly, the invention is a backless and strapless push-up bra having a pair of bra cups having a clasp for attaching the cups together, for providing freedom and comfort from the absence of bra straps and side extensions.

It is another object of the invention to provide a push-up bra that lifts up the breasts for enhancing cleavage. Accordingly, the bra cups have a periphery that is attached to a flange, having an adhesive lining. The adhesive lining of the flange secures to an area of skin directly underneath and around the breasts for lifting and supporting the breasts, which therefore enhances cleavage.

It is another object of the invention to provide a push-up bra that is adapted to look and feel like real breasts. Accordingly, the bra cups of the invention are made from flexible silicon for giving them the look and feel of real breasts. In addition, the push-up bra of the invention includes a pair of adhesive nipples for attaching to the bra cups for creating more realistic looking breasts.

It is another object of the invention to provide a push-up bra that is capable of providing additional support to a pair of breasts. Accordingly, the bra cups of the invention have an adhesive lining that attaches directly over each breast for creating additional support to the breasts thereunder.

It is another object of the invention to provide a push-up bra that is sensitive to all types of skin. Accordingly, the push-up bra of the invention is made from a silicon or jell material that is hypoallergenic for safely adapting to all types of skin.

The invention is a push-up bra for wear by a user, having a pair of breasts. The push-up bra includes a pair of cups each having a periphery. A flange extends outwardly from a portion of the periphery of each cup. The flange has a first surface, a side tab, and an upper tab. The first surface of the flange has an adhesive lining for easily attaching around the breasts of the user. A clasp is attached to a portion of the flange between each breast and holds the cups securely in position against the breasts. The side tabs and upper tabs are pulled taughtly to lift the breasts and enhance cleavage.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
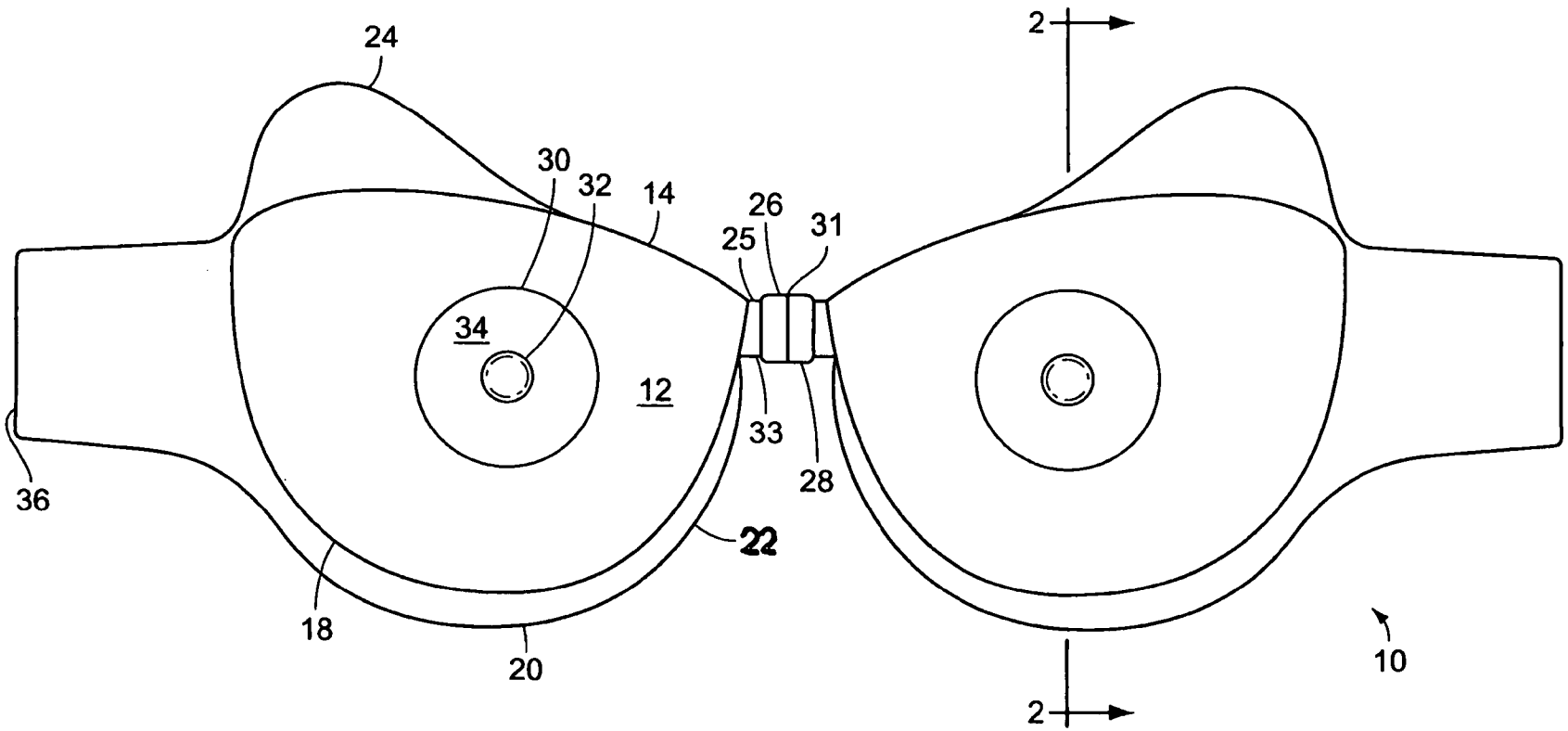
FIG. 1 is a front elevational view of the push-up bra of the present invention having a pair of cups each having a flange, attached by a clasp therebetween the cups, for lifting and supporting a pair of breasts.

FIG. 1 illustrates the push-up bra 10 of the invention worn by a user having a pair of breasts. The user has an area of skin surrounding and between said breasts, and an area of skin underneath each arm that is adjacent to each breast. A user having under-developed breasts, or no breasts at all, including those users who have undergone mastectomy operations, may also wear the invention. The push-up bra 10 has a pair of cups 14, preferably molded of silicon, having an interior surface and an exterior surface 12. The cups 14 are substantially oval in shape and are slightly contoured to fit over and cover the breasts of the user. The cups 14 include a periphery 18. A flange 20 is attached to each of the cups 14 by extending outwardly from a portion of the periphery 18 of the cups 14. The flanges 20 each have a first surface 22, an upper tab 24, and a side tab 36.

A clasp 26 is attached to a portion of the cups 14, positionable in between the breasts of the user, and is used to align and secure the cups 14 against the breasts of the user. The clasp 26 includes two sides 28, a fastener 31, and a pair of connecting flails 25. The two sides 28 of the clasp 26 interlock and secure together along the fastener 31 for holding the cups 14 in position against the breasts. One of the connecting flails 25 is attached to each of the sides 28 of the clasp 30 and secure the clasp 26 to the cups 14. The connecting flails 25 each have a first end 33, which extends outwardly from a portion of the periphery 18 of each cup 14 between the breasts and connects to each side 28 of the clasp 26. In addition, the flange 20 for each cup 14 extends outwardly from a portion of the periphery 18 of that cup 14 that is directly opposite from the clasp 26.

A pair of nipples 30 are attached to the exterior surface 12 of each of the cups 14 for providing a natural appearance when the push-up bra 10 is worn by the user. The nipples 30 each have a circular backing member 34 having an adhesive lining for securing and removing the nipples 30 from the cups 14. The nipples 30 have a protrusion 32 that is circular in shape, and attaches to the circular backing member 34. The protrusion 32 extends outwardly from the circular backing member 34. The nipples 30, preferably made of silicon, are flexible and bendable for permitting the cups 14 to look and feel more like a real breast.

The upper tabs 24 of each flange 20 are positionable above the breast and extend outwardly from a portion of the periphery 18 of each cup 14. The upper tabs 24 of the flanges 20 are used to help lift the breasts of the user upwardly, thereby enhancing cleavage. The side tabs 36 of each flange 20 are positionable against the area of skin underneath the arms and adjacent to each breast. Each side tab 36 of the flange 20 extends outwardly from a portion of the periphery 18 of the cups 14. When each side tab 36 is pulled tightly and attached to the user, the portion of the flange 20 underneath each breast holds the breast in place. This increases the amount of lift the push-up bra provides to the breasts. In addition, the side tabs 36 increase the amount of pressure the cups 14 exert against each breast and thereby help to increase the amount of cleavage that is enhanced.

Figure 2:
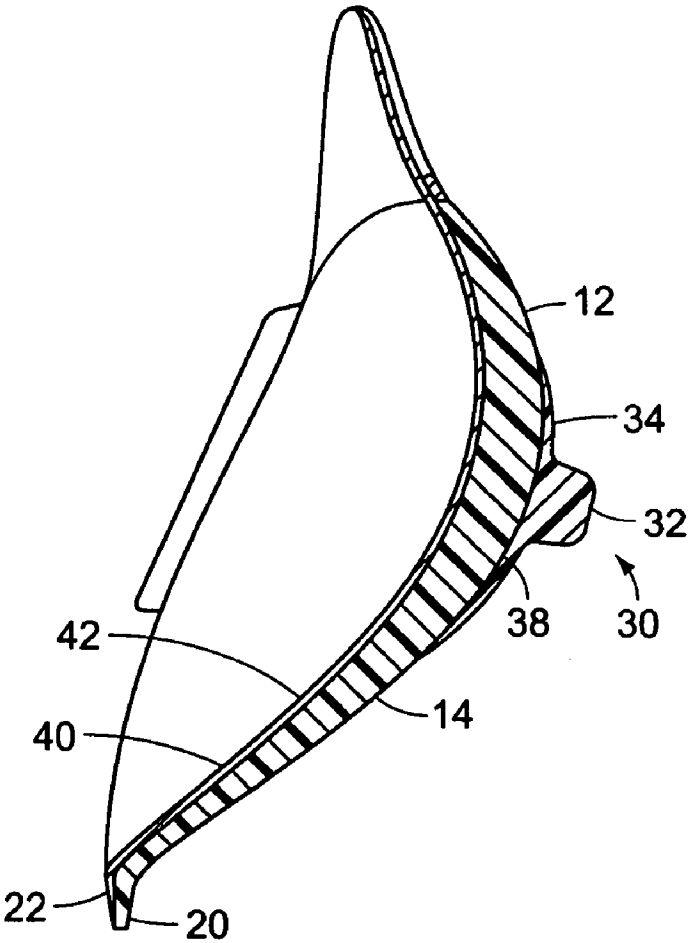
FIG. 2 is a cross-sectional view of one of the cups of the push-up bra, having an interior surface having an adhesive lining for attaching and covering one of the breasts, and an exterior surface having a nipple attached thereto.

FIG. 2 illustrates a cross-sectional view of one of the cups 14 of the push-up bra. The interior surface 40 of the cup 14 is shown contoured to fit against and cover the breast of the user. The flange 20 of the cup 14 is substantially planar with the cup 14 and a portion of the flange 20 is shown positioned just underneath the breast to lift and support the breast. The push-up bra 10 is sized to fit each user and therefore the size, shape, and contour, of the cups 14 may differ depending on the size of the push-up bra.

The interior surface 40 of each cup 14, and the first surface 22 of each flange 20, have an adhesive lining 42 for securing the cups 14 to the breasts. The adhesive lining 42 further attaches the flanges 20 to the area of skin surrounding the breasts, such that the cups 14 therebetween cover the breasts. The flanges 20 are positioned around each breast, and particularly, underneath each breast, for supporting each breast from sagging. The adhesive linings 42 of each flange 20 prevent the breasts from sagging, while helping to lift the breast upwardly in the push-up bra during use. The adhesive lining 42 of the interior surface 40 of each cup 14 attaches directly to the breasts for providing the push-up bra with additional support.

The user positions the nipples 30 on the cups 14 of the push-up bra 10 to give the push-up bra 10 a more natural appearance. The nipples 30 are removable and do not need to be worn with the push-up bra at all times. The adhesive lining 38 of the circular backing members 34 of each nipple 30 are easily attached by adhesion to the exterior surface 12 of each cup 14 and can be easily re-positioned and removed. The circular protrusion 32 extends outwardly from the circular backing members 34 for naturally resembling a nipple.

Figure 3:
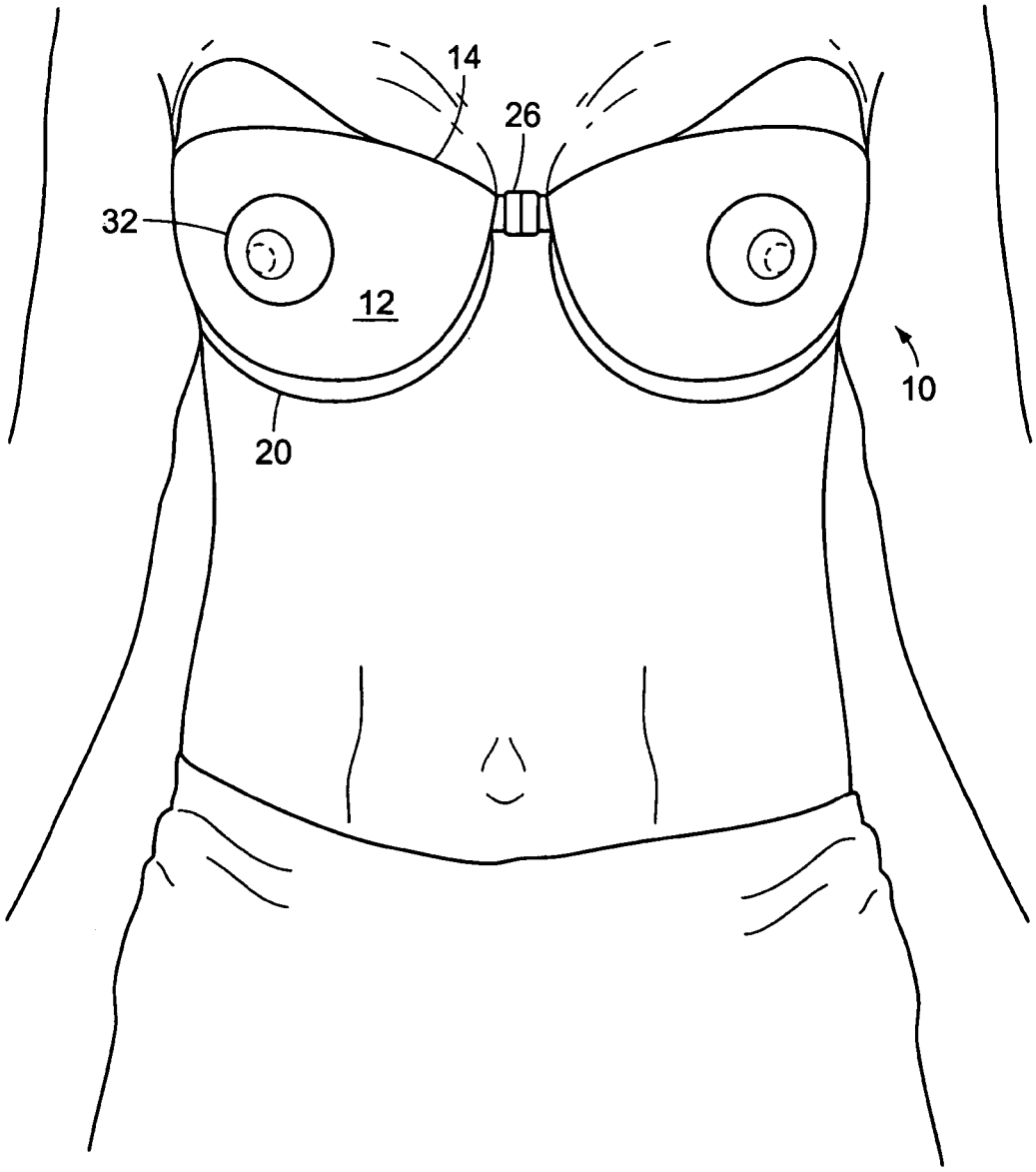
FIG. 3 is a diagrammatic perspective view of the push-up bra of the present invention being worn by a user to support their breasts and to naturally lift and enhance the appearance of cleavage.

FIG. 3 illustrates the push-up bra 10 in use covering the breasts of the user. The push-up bra 10 of the invention is used to enhance cleavage and lift breasts, while providing comfort and support to the user. The push-up bra 10, as shown, is both backless and strapless and is perfect for use underneath backless or strapless dresses and thin-strapped dresses. The clasp 26 of the push-up bra 10 is properly positioned between the breasts of the user for aligning the cups 14 and holding the cups 14 securely against the breasts. The flanges 20 of the cups 14 are positioned around the breasts. In particular, the adhesive lining of the flanges 20 and cups 14 secures directly to the skin around and covering the breasts for lifting and supporting the breasts, thereby enhancing cleavage. The adhesive lining is reusable, thereby allowing the user to wear the push-up bra 10 multiple times. The nipples 30 are attached to the exterior surface 12 of the cups 14 for giving the push-up bra 10 a more natural appearance.

In conclusion, herein is presented a push-up bra having attachable nipples. The invention is illustrated by example in the drawing figures, and throughout the written description. It should be understood that numerous variations are possible, while adhering to the inventive concept. Such variations are contemplated as being a part of the present invention.

What is claimed is:

1. A push-up bra for wear by a user, having a pair of breasts, having an area of skin surrounding and between said breasts, and an area of skin underneath each arm adjacent to each breast, comprising:

a pair of cups, each having an interior surface, an exterior surface, and a periphery;

a flange having a first surface, an upper tab, and a side tab, said upper and side tabs extending outwardly from a portion of the periphery of the cups for lifting the breasts;

an adhesive lining coupled to the first surface of the flange, whereby said flange is adapted for attaching to the area of skin surrounding the breasts such that the cups cover the breasts; and a clasp attached to a portion of the periphery of each cup for holding the pair of cups in alignment against the breasts and said clasp in between each breast.

2. The push-up bra of claim 1, wherein the interior surface of the pair of cups each have an adhesive lining for attaching directly to the breasts for additional support.

3. The push-up bra of claim 2, wherein a pair of nipples are attached to the exterior surface of each of the cups for providing a natural appearance when said cups are worn by the user.

4. The push-up bra of claim 3, wherein the nipples each have a protrusion attached to a circular backing member, having an adhesive lining, for removably securing said nipples to the cups.

5. The push-up bra of claim 4, wherein the protrusion of each nipple is circular in shape and extends outwardly from the circular backing member.

6. The push-up bra of claim 5, wherein the side tabs of the flanges extend outwardly from a portion of the periphery of the cup directly opposite the clasp and positionable against the area of skin underneath the arms adjacent to each breast, for comfortably securing the push-up bra to the user.

7. The push-up bra of claim 6, wherein the clasp has two sides and a connecting flail attached to each side of the clasp, for connecting said clasp with a portion of the periphery of each cup.

8. The push-up bra of claim 7, wherein the clasp has a fastener for connecting each side of said clasp securely together.

9. The push up bra of claim 8, wherein the connecting flails have a first end, and said first end extends outwardly from the periphery of each cup and connects the cups to the clasp.

10. The push-up bra of claim 1, wherein the cups are molded out of silicon for providing a user with enhanced cleavage that both looks and feels like real breasts.

11. A method of wearing a push-up bra by a user underneath a strapless and backless garment, said push-up bra including a pair of cups and removable secured nipples, said cups having an adhesive lining and a flange having an adhesive lining, said flange having a side tab and an upper tab, said push-up bra having a clasp attached to each cup for connecting the cups together, the steps comprising:

enhancing cleavage of the user by lifting and supporting the breasts of the user, by positioning the push-up bra over the breasts of the user, by positioning the cups on top of each breast, by attaching the flanges of each cup around the breasts, by pulling on the side and upper tabs tightly and securing the side tabs of each flange underneath each arm of the user, and securing the upper tabs of each flange above each breast of the user.

12. The method of wearing a push-up bra of claim 11, wherein the nipples are attached to the cups for providing a more natural appearance.

13. The method of wearing a push-up bra of claim 11, wherein the adhesive lining of the flanges and cups is reusable, allowing the push-up bra to be worn by a user multiple times.

* * * * *